US007877826B2

(12) United States Patent
Franklin

(10) Patent No.: US 7,877,826 B2
(45) Date of Patent: Feb. 1, 2011

(54) HANDS FREE OPERABLE FOOT WASHING STATION

(76) Inventor: James D. Franklin, P.O. Box 1156, Trenton, GA (US) 30752

( * ) Notice: Subject to any disclaimer, the term of this patent is extended or adjusted under 35 U.S.C. 154(b) by 1134 days.

(21) Appl. No.: 11/491,561

(22) Filed: Jul. 21, 2006

(65) Prior Publication Data

US 2007/0017021 A1 Jan. 25, 2007

Related U.S. Application Data

(60) Provisional application No. 60/701,792, filed on Jul. 22, 2005.

(51) Int. Cl.
*A47K 3/00* (2006.01)

(52) U.S. Cl. ..... 4/615

(58) Field of Classification Search ..... 4/605, 4/615, 616

See application file for complete search history.

(56) References Cited

U.S. PATENT DOCUMENTS 2,641,771 A 6/1953 Schiro
2,654,894 A 10/1953 Van Dijck
3,170,171 A * 2/1965 Mayhew et al. ..... 4/615
3,326,551 A * 6/1967 Clarke ..... 482/81
3,416,178 A 12/1968 James
3,499,792 A * 3/1970 Veith ..... 134/1
3,548,439 A * 12/1970 Berst ..... 15/104.92
3,925,830 A 12/1975 Delaney
4,918,779 A 4/1990 Burns
5,173,972 A 12/1992 Goodman
5,367,720 A 11/1994 Stephens et al.
5,964,959 A 10/1999 Bleth
6,618,870 B2 9/2003 Farias
6,668,842 B1 12/2003 Wilke et al.

* cited by examiner

*Primary Examiner*—Huyen Le
(74) *Attorney, Agent, or Firm*—Stephen J. Stark; Miller & Martin PLLC

(57) ABSTRACT

A plurality of nozzles are located on each side of a foot washing station on curved portions of spray members. At least some of the nozzles are located at a plurality of elevations and are downwardly directed to knock debris off the lower leg and foot of a user to thus wash the debris away. A foot platform supports the foot or feet of a user is preferably continuously sloped so that water does not accumulate at any portion of the foot platform. Additionally, an actuator is preferably actuated by the placement of the weight of the foot on the foot platform to begin the spraying of the foot or feet with water in a hands-free operation. Spray nozzle tips are screwed into orifices which then dispense water under pressure preferably in a spray pattern with highly atomized water pellets efficiently removing debris from the feet of a user.

20 Claims, 2 Drawing Sheets

HANDS FREE OPERABLE FOOT WASHING STATION

This application claims the benefit of U.S. Provisional Patent Application No. 60/701,792 filed Jul. 22, 2005.

BACKGROUND OF THE INVENTION

1. Field of the Invention

This invention relates to a foot shower and spray device for washing the lower legs and feet of a user, and more particularly to a foot washing station for use after leaving the beach or pool and/or prior to entering a pool.

2. Description of Related Art

A number of foot washing stations have been developed in the prior art. U.S. Pat. No. 2,654,894 shows a foot bath having this device has foot engaging portions 66 where a user stands while water is distributed "outwardly and upwardly". Water collects within the upstanding walls 10 of the bath. When the user leaves the platform 66, the plug 63 moves away from the drainage port 17 to allow the bath to drain.

U.S. Pat. No. 2,641,771 is another foot washer which directs water through apertures or orifices 38 of spraying member 32 at the inserted feet of a user. Once again, handles 50,52 are utilized to start the process of providing water through the foot washer. This device also has a flat bottom tub 28 which would appear to tend to allow water to pool up and redistribute debris back onto the feet.

U.S. Pat. No. 3,416,178 shows a foot washer massager that does not have a spray capability except for the shower that it is used in. Also, the brush back plates 76 is also planar which could allow water to stand thereon thus allowing any debris floating on the water to once again adhere to the foot of the user.

U.S. Pat. No. 3,925,830 shows a hands-free foot shower and spray device. This device directs water from two opposing spray heads onto the foot of a user. This device has a flat top 71 with a slope 73 along its periphery to assist in draining water. However, from the appearance of this device there does not appear to be a mechanism to drain water from the flat top 71. Additionally, since water is directed only from two opposing stations, there is believed to exist the possibility of blind spots where debris may remain on the foot of a user. Finally, there does not appear to be any means to stop overspray so that a person walking by the unit is not hit with overspray of water by a person utilizing the device.

U.S. Pat. No. 4,918,779 shows a foot spraying cleaning device which directs water in between two brush assemblies. A foot actuated bar controls the flow of water onto the foot.

U.S. Pat. No. 5,964,959 shows a shoe cleaning device adapted to clean the bottom of the shoe and not the sides or the top of a foot.

U.S. Pat. No. 5,367,720 shows a foot washer apparatus which is activated without the use of hands. The actuator plate 24 may allow at least some water to pool around the user's feet.

U.S. Pat. No. 5,173,972 shows another automated foot washer which is activated by a person stepping on an actuating platform. The spray is directed at about the level of the feet in this device and there is no provision for stopping overspray.

U.S. Pat. No. 6,668,842 shows an apparatus and method for sanitizing and washing footwear with four spray nozzles at a common elevation.

While there have been numerous attempts to create an approved foot washing station, none of these prior art devices are believed to provide a satisfactory device for use in cleaning the lower leg of a person in addition to the feet such as would occur as a person is walking off the beach situation. Especially if the person's hands are full of umbrellas, towels, chairs and other assorted gear from carrying back and forth to the beach, hands free operation is particularly desirable in such an application.

SUMMARY OF THE INVENTION

A need exists for an improved foot washing station.

Another need exists for a foot washing station which incorporates advantages of the prior art and employs new technology to provide an improved foot washing station.

Another need exists for a foot washing station which directs water onto the legs and feet of the user in a hands free operation to dislodge sand or debris from the legs such as before entering a pool or after leaving a beach, etc.

Another need exists for a foot washing station having a plurality of jets located above the foot of the user at more than one elevation and in a non-linear arrangement so that a plurality of differently oriented streams of water spray and/or mist can be directed at the foot with at least some of them directed downwardly to wash debris, dirt, etc., away from the leg and foot of the user.

Accordingly, in the presently preferred embodiment of the present invention, a plurality of nozzles are located on each side of a foot washing station on spray members. At least some of the nozzles are downwardly directed to knock debris off the lower leg and foot of a user to thus wash the debris away. In order to most efficiently remove debris, the nozzles are preferably located at a plurality of elevations. At least some of the nozzles on each side are preferably non-linearly disposed relative to one another and are located at an elevation above the feet of the user.

The platform supporting the foot or feet is preferably continuously sloped so that water does not accumulate at any portion of the foot platform. Additionally, an actuator is preferably actuated by the placement of the weight of the foot on the foot platform to begin the spraying of the foot or feet with water in a hands-free operation. In the preferred embodiment, spray nozzle tips are screwed into manifolds which then dispense water under pressure preferably in a spray fashion with highly atomized water pellets efficiently removing debris from the feet of a user.

BRIEF DESCRIPTION OF THE DRAWINGS

The particular features and advantages of the invention as well as other objects will become apparent from the following description taken in connection with the accompanying drawings in which.

DETAILED DESCRIPTION OF THE DRAWINGS

Figure 1:
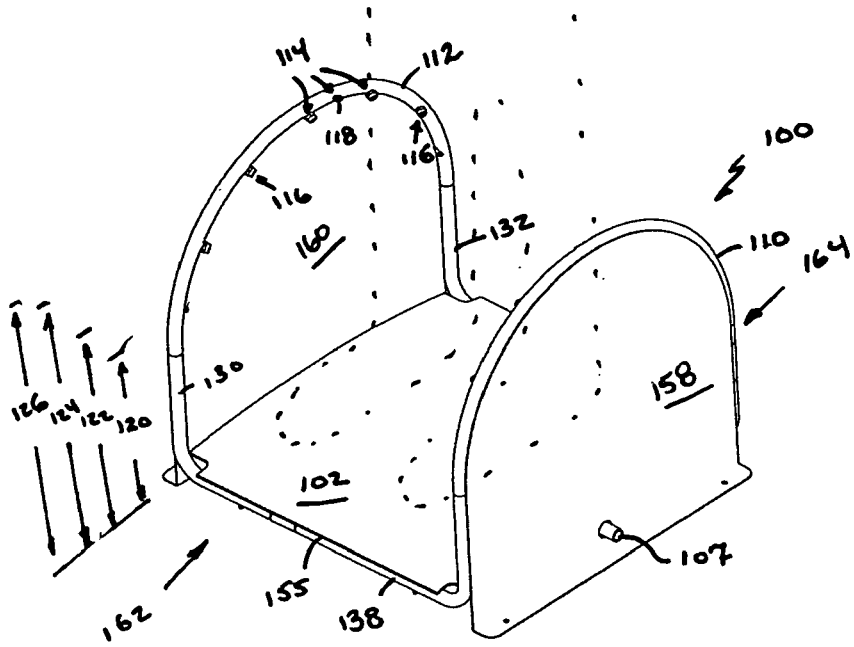
FIG. 1 shows a upper elevational perspective view of a foot washing station constructed in accordance with the presently preferred embodiment of the present invention with a human foot portion shown in phantom as well as some portions obscured from view by a first panel shown in phantom.

FIG. 1 shows a foot washing station 100 showing the presently preferred embodiment of the present invention. The foot washing station 100 is composed of a foot platform 102 which accepts the foot, or more preferably feet, of a user as shown in phantom in FIG. 1. The platform 102 is preferably constructed of material such as skid resistant metal or plastic such as diamond plate aluminum, molded plastic with ridges, etc. Starboard formed plastic is shown forming the platform 102 in FIG. 1.

Figure 2:
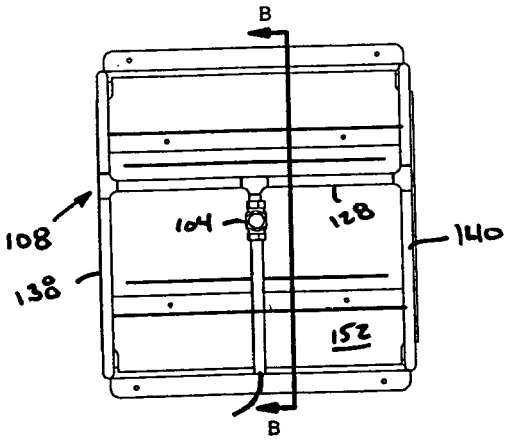
FIG. 2 shows a bottom view of the base and some of the manifold of the foot washing station shown in FIG. 1.
Figure 3:
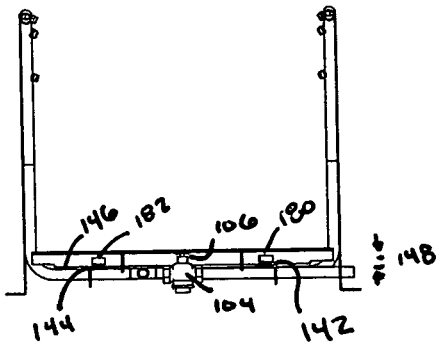
FIG. 3 shows a side cross-sectional view taken along line B-B of FIG. 2 of a foot platform, valve and base of the foot washing station shown in FIG. 1.
Figure 4:
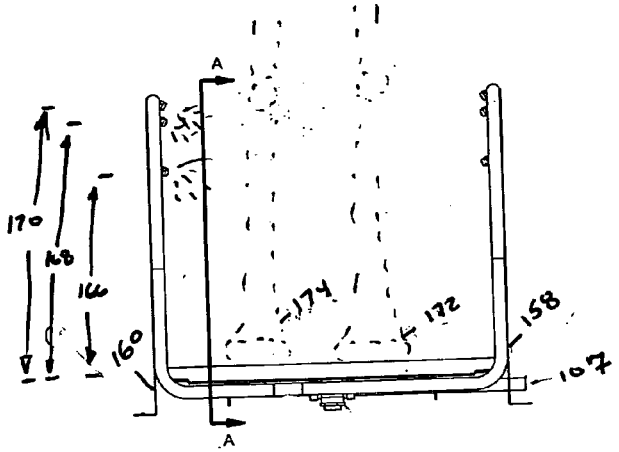
FIG. 4 shows a front view of the foot washing station shown in FIG. 1.
Figure 5:
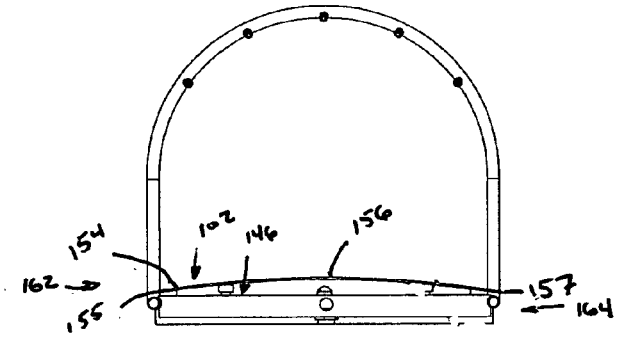
FIG. 5 shows a cross-sectional view taken along the line A-A in FIG. 4.

As a user steps on foot platform 102, valve 104 shown in FIGS. 2 and 3 opens as the platform contacts and depresses actuator 106 thereby opening valve 104 allowing the flow of water through valve 104 shown in FIGS. 1 and 2 from a supply 107 such as a pipe, hose, etc., through valve 104 into the manifold 108 as shown in FIG. 2. The manifold 108 distributes water to spray members 110,112 preferably having a plurality of orifices 114. Preferably, at least some of the orifices 114 have spray nozzles 116 placed therethrough. The nozzles 116 receive water which passes through orifices 114 and then sprays this water into the foot washing station 100 preferably at the inserted feet and/or lower legs. Caps or plugs 118 can be useful in other embodiments to plug orifices 114 which are not utilized in conjunction with spray nozzles 116. In some embodiments, orifices 114 having plugs 118 may not be utilized to spray. The nozzles 116 preferably screw into orifices 114.

The nozzles 116 and/or orifices 114 are preferably disposed at a plurality of elevations 120,122,124,126 relative to the feet of a user. Additionally, at least a portion of the spray members 110,112 are non-linear with non-adjacent nozzles 116 and orifices 114 being non-linear relative to non-agreement or agreement nozzles 116 and orifices 114 such as on a curved span. This can be clearly seen from the spray member 112 shown in FIG. 1. The applicant has discovered that these different elevations of non-linear assist in providing a spray which efficiently removes debris and/or other material from the lower leg and feet of a user. By having the nozzles 116 and/or orifices 114 disposed above the feet, a downward spray pattern has also been found to efficiently remove such debris or other material from the feet of a user. Other or additional spray patterns could also be employed.

Nozzles 116 are preferably spray nozzles which distribute water over a specified pattern under desired pressure. The water pressure can be estimated based on known conditions thus allowing optimum selection of nozzles 116. Spray patterns for nozzles 116 are also selectable such as full cone, cone, square cone, etc. It is preferred that nozzles 116 provide small water droplets such as mist to assist in cooling water which may have been heated by sun shining on the spray members 110,112.

As water proceeds from the supply 107 through valve 104 in the manifold 108, in the preferred embodiment it can proceed through support arms 130,132 to spray member 112 and through either or both of conduits 138,140 to the other spray member 110. Manifold 108 can include director pipe 128 as well. Other water flows can be provided from the supply 107 through valve 104 to each of the spray members 110,112 as is known in the art.

As the user steps upon the foot platform 102, the actuator 106 is depressed as springs 142,144 are depressed. At least a portion of the foot platform 102 preferably contacts the actuator 106 sufficient to at least partially open the valve 104. In the preferred embodiment, the platform 102 bottoms out against at least a portion of base 146 after traveling a predetermined distance. This predetermined distance 148 is preferably about the same length of travel as the actuator travel 106 to open the valve 104. It is also preferably a little less than maximum travel of the actuator 106 to prevent excessive wear. A recess could be useful to allow the valve 104 to fit below the foot platform and operate properly with the surface of a recess contacting the actuator 106. The recess could be recessed relative to an interior surface 152 of the platform 102. The exterior surface 154 of the platform 102 is preferably sloped from a peak 156 which may be curved down to its sides 155,157 so to provide a water runoff point for the entire foot platform 102. This is believed to enhance the removal of debris from the feet as it doesn't give the opportunity for debris to puddle up on the foot platform 102 which is believed to be possible with many, if not all, of the prior art designs.

Panels 158,160 are useful to restrain overspray past the opposing panels 158,160 so that someone walking by the side of the foot washing station 100 in operation may not be hit with overspray. The front 162 and back 164 are preferably unobstructed above the foot platform 102 to allow an individual to walk in and out in a relative easy manner. In fact, multiple foot washing stations 110 can be placed in a row and possibly connected together so that a user could walk through it and potentially not stop or stop for a relatively short period of time to adequately remove debris from his or her legs.

When the user removes his/her weight from the foot platform 106, springs 142,144 preferably return the foot platform 102 to the position shown in FIG. 2 thereby allowing the actuator to return to the off position to shut valve 104.

FIG. 1 is useful to show various elevations 166,168,170 as it relates to the feet and legs 172,174 of the user.

Alternatively preferred embodiments of the present invention of a foot washing station with a foot platform could have members 26 with parallel members which have spray holes or nozzles therein. Upwardly extending members could support the parallel members and receive water and are connected together by at least one lower conduit if not two. The valve could be lever activated with a lever and spring members could be useful to support the foot platform so that the lever would not be actuated in a non-in-use position. When a force is applied to the platform the springs could depress allowing the lever to be depressed allowing water to flow from the inlet to the valve and into the various portions of the conduit, upward members and to the spray members. Of course, the upward members could also have holes. The valve is preferably actuated by the force of the persons weight on the foot platform 12.

In this alternately preferred embodiment, instead of forming the foot platform from aluminum, it could be injection molded or vacuum molded or otherwise molded from plastic but still preferably sloped from a top peak down to the sides so that water does not puddle up on the foot platform.

Figure 6:
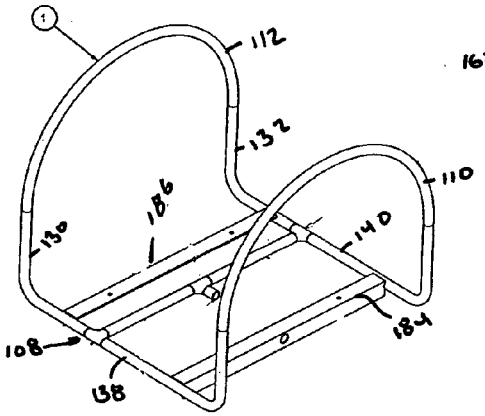
FIG. 6 shows a top perspective view of a portion of a foot washing station with the foot platform, valve, side panels, and supply piping removed and before machining orifices into the spray members of the foot washing station.
Figure 7:
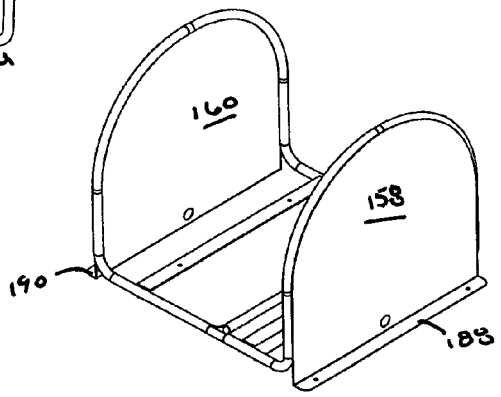
FIG. 7 shows the structure of FIG. 6 with the side panels installed.

The development of the applicant's invention has been an ongoing process. One advantage of the presently preferred embodiment shown in FIGS. 1-5 is that the spray nozzles and the diameter of the members of the manifold 108 have been selected so that the water pressure provided to the nozzles 106 in sufficient to get the desired spray pattern from the nozzles 106. The placement of the nozzles 106 has also been selected to enhance the spray coverage and removal of debris from the legs in a sufficient manner which is not believed to have been done in the prior art. The parabolic shape of the spray members 110,112 is also believed to be advantageous as is the sloped nature of the foot platform 102. The platform 102 is preferably constructed so that cups 180,182 go at least about a portion of springs 142,144 and contact the base 146 which is illustrated in FIG. 6 as cross-members 184,186. These members are illustrated as angle iron which preferably do not extend downwardly below the bottom surface of conduits 138,140. By having this construction, it is possible that panels 158,160 can have feet 188,190 which contact the surface such as a side walk, grassy area, etc., and support the foot washing station 100 thereabove in a somewhat level manner so that it doesn't rock around when installed.

Numerous alterations of the structure herein disclosed will suggest themselves to those skilled in the art. However, it is to be understood that the present disclosure relates to the preferred embodiment of the invention which is for purposes of illustration only and not to be constructed as a limitation of the invention. All such modifications which do not depart from the spirit of the invention are intended to be included within the scope of the appended claims.

Having thus set forth the nature of the invention, what is claimed herein is:

1. A foot washing station comprising:

a foot platform having a front and a back accessible from the front, back and above;

a valve connectable to a supply of water;

an actuator operably coupled to the foot platform wherein when a user steps on the foot platform the actuator transitions the valve from a closed to an open position;

a manifold connected to the valve, said manifold connected to upwardly extending and opposing spray members, said spray members each having a plurality of orifices including a first and a second orifice disposed at least at a first and a second elevation respectively above the foot platform providing a spray pattern at least on top of a foot when on the foot platform; wherein said first orifice is located above the foot platform and closer to the front of the foot platform than the second orifice, and the second orifice is located above the first orifice.

2. The foot washing station of claim 1 wherein said spray members have a curved span extending from towards the front of the first platform to towards the back of the foot platform with the plurality of orifices on the curved span.

3. The foot washing station of claim 2 wherein the spray members are disposed on opposite sides of the foot platform and the user may walk between the spray members to access the foot washing station.

4. The foot washing station of claim 3 further comprising planar panels on the opposite sides of the foot platform external to the spray members relative to the foot platform.

5. The foot washing station of claim 4 wherein the panels direct spray that contacts them toward the foot platform.

6. The foot washing station of claim 5 wherein the foot platform has an upper surface sloping downwardly toward at least one of the front and the back from a peak intermediate the front and the back.

7. The foot washing station of claim 6 wherein the foot platform slopes downwardly toward the front and the back from the peak and provides a skid resistant surface;

and the peak is at a midpoint of the foot platform.

8. The foot washing station of claim 1 wherein the plurality of orifices are disposed at least at the first, the second, and a third elevation above the foot platform, and at least one of the plurality of orifices are non-linear relative to others of the plurality of orifices.

9. The foot washing station of claim 8 wherein the spray members are symmetrically disposed relative to the foot platform.

10. The foot washing station of claim 9 wherein the spray members have parabolic portions with the orifices disposed thereon.

11. The foot washing station of claim 9 further comprising nozzles connected to the orifices providing the spray pattern, said nozzle selected from the group of fulcrum, square cone and cone.

12. A foot washing station comprising:

a foot platform having a front and a back accessible from the front, back and above;

a valve connectable to a supply of water;

an actuator operably coupled to the valve which transitions the valve from a closed to an open position;

a manifold disposed below the foot platform and connected to the valve, said manifold connected to upwardly extending spray members, said spray members having opposing first and second orifices disposed at least at a first and a second elevation above the foot platform said first and second orifices non-linearly disposed relative to a direction from the front to the back of the foot platform and are elevationally spaced relative to each other above the foot platform.

13. The foot washing station of claim 12 wherein the actuator is operably coupled to the foot platform and stepping on the foot platform transitions the valve from the closed to the open configuration and stepping off the foot platform allows the valve to transition from the open to the closed configuration.

14. The foot washing station of claim 13 wherein at least one of the actuator and the foot platform is reset spring protected from full compression biased for the valve to be in the closed position.

15. The foot washing station of claim 14 wherein the foot platform slopes downwardly toward at least one of the front and the back from a peak intermediate the front and the back.

16. The foot washing platform of claim 12 further comprising nozzles connected to the orifices which provide a spray pattern at least partially above the foot platform.

17. The foot washing platform of claim 12 wherein the spray members have curved portions with the orifices disposed thereon.

18. A foot washing station comprising:

a foot platform having an upper surface a front and a back with a peak on the upper surface intermediate the front and back with the upper surface sloping downwardly toward at least one of the front and the back from the peak said foot platform accessible from the front, back and above;

a valve connectable to a supply of water;

an actuator operably coupled to the valve which transitions the valve from a closed to an open position;

a manifold connecting the valve to upwardly extending and opposing spray members, said spray members having at least three orifices disposed at least at a first elevation above the foot platform.

19. The foot washing station of claim 18 wherein the spray members have curved portions with orifices connected to nozzles at the first and a second elevations above the foot platform along the curved portions of the spray members.

20. The foot washing station of claim 19 wherein the actuator is operably coupled to the foot platform and stepping on the foot platform transitions the valve from the closed to the open position.

* * * * *